US007784226B2

(12) United States Patent
Ichikawa et al.

(10) Patent No.: US 7,784,226 B2
(45) Date of Patent: Aug. 31, 2010

(54) JOINT STRUCTURE FOR ANTISEISMIC REINFORCEMENT

(75) Inventors: Yasushi Ichikawa, Chiyoda-ku (JP); Eiichiro Saeki, Chiyoda-ku (JP); Akira Wada, Yokohama (JP)

(73) Assignee: Nippon Steel Corporation, Tokyo (JP)

( * ) Notice: Subject to any disclaimer, the term of this patent is extended or adjusted under 35 U.S.C. 154(b) by 1290 days.

(21) Appl. No.: 11/280,239

(22) Filed: Nov. 17, 2005

(65) Prior Publication Data

US 2006/0112652 A1 Jun. 1, 2006

(30) Foreign Application Priority Data

Nov. 26, 2004 (JP) ..... 2004-342469
Mar. 23, 2005 (JP) ..... 2005-083022

(51) Int. Cl.
*E04B 1/98* (2006.01)

(52) U.S. Cl. ..... 52/167.1; 52/656.9; 52/573.1; 52/693; 52/715

(58) Field of Classification Search ..... 52/167.3, 52/167.2, 167.1, 167.4, 724.5, 723.1, 731.7, 52/167.7, 573, 690, 169.7, 715, 169.8, 167.5, 52/167.6, 167.8, 167.9, 656.9, 573.1, 693; 249/219.1, 167, 219.2, 210, 207.4, 207.5, 249/207.6, 208, 207.2, 207.3, 2–9; 403/104, 403/108, 347, 379, 393, 231, 382, 403; 14/4, 14/13, 14, 74.5
See application file for complete search history.

(56) References Cited

U.S. PATENT DOCUMENTS 3,691,712 A * 9/1972 Bowling et al. ..... 52/393
3,793,790 A * 2/1974 Love et al. ..... 52/393
4,409,765 A * 10/1983 Pall ..... 52/167.1
4,441,289 A * 4/1984 Ikuo et al. ..... 52/167.1
5,076,536 A * 12/1991 Fitzgerald ..... 249/219.1

(Continued)

FOREIGN PATENT DOCUMENTS

FR 2609745 A1 * 7/1988

(Continued)

OTHER PUBLICATIONS

"connect." Merriam-Webster Online Dictionary. 2009. Merriam-Webster Online. Apr. 10, 2009 <http://www.merriamwebster.com/dictionary/connect>.*

*Primary Examiner*—Richard E Chilcot, Jr.
*Assistant Examiner*—James Ference
(74) *Attorney, Agent, or Firm*—Birch, Stewart, Kolasch & Birch, LLP

(57) ABSTRACT

A joint structure for antiseismic reinforcement includes at least one structural member having a longitudinal axis and at least one antiseismic reinforcement member. Each antiseismic reinforcement member has a longitudinal axis located in a plane that is generally parallel to the longitudinal axis of the structural member. The longitudinal axis of the antiseismic reinforcement member is inclined with respect to the longitudinal axis of the structural member. A metal fitting connects each of the antiseismic reinforcement members to the structural member. The metal fitting is not fixed to the structural member. At least one constraining member is fixed to the structural member close to or abutting an edge portion of the metal fitting. The constraining member bears a force applied to the metal fitting in a direction generally parallel to the longitudinal axis of the structural member.

22 Claims, 14 Drawing Sheets

U.S. PATENT DOCUMENTS

| | | | | | |
|---|---|---|---|---|---|
| 5,630,298 | A | * | 5/1997 | Tsai et al. | 52/167.3 |
| 5,845,438 | A | * | 12/1998 | Haskell | 52/167.1 |
| 6,318,032 | B2 | * | 11/2001 | MacKarvich | 52/167.3 |
| 6,378,670 | B1 | * | 4/2002 | Kawakami et al. | 188/256 |
| 7,076,926 | B2 | * | 7/2006 | Kasai et al. | 52/167.8 |
| 7,225,588 | B2 | * | 6/2007 | Nakamura et al. | 52/167.3 |

FOREIGN PATENT DOCUMENTS

| | | | | |
|---|---|---|---|---|
| JP | 01169066 | A | * | 7/1989 |
| JP | 02209569 | A | * | 8/1990 |
| JP | 02209570 | A | * | 8/1990 |
| JP | 9-279858 | A | | 10/1997 |
| JP | 10-184031 | A | | 7/1998 |
| JP | 10-317684 | A | | 12/1998 |
| JP | 11-50690 | A | | 2/1999 |
| JP | 2002371626 | A | * | 12/2002 |
| JP | 2004-270319 | A | | 9/2004 |
| JP | 2004270319 | A | * | 9/2004 |

* cited by examiner

JOINT STRUCTURE FOR ANTISEISMIC REINFORCEMENT

CROSS-REFERENCE TO RELATED APPLICATIONS

This nonprovisional application claims priority under 35 U.S.C. §119(a) on Patent Application Nos. 2004-342469 and 2005-083022, filed in Japan on Nov. 26, 2004 and Mar. 23, 2005, respectively. The entirety of each of the above-identified applications is incorporated herein by reference.

BACKGROUND OF THE INVENTION

1. Field of the Invention

The present invention relates to a joint structure for antiseismic reinforcement that is applied to a structural member.

2. Description of Background Art

It is known in the background art to reinforce a structure against antiseismic activity. In particular, it is known to use an antiseismic reinforcement member, such as a brace, that is connected at an intersection between a column and beam to reinforce a structure against antiseismic activity.

In the situation where a structure is made of a steel skeleton, a metal fitting for connecting the antiseismic reinforcement member to a column or beam is typically fixed by welding at an intersection between a column and beam on site.

In the situation where a structure is a reinforced concrete structure or a steel skeleton reinforced concrete structure, a steel framework has been used to install the antiseismic reinforcement member.

In addition, other inventions for connecting an antiseismic reinforcement member are known in the background art. For example, a structure that uses a metal fitting to fix an antiseismic reinforcement member to a column of a reinforced concrete structure or a steel skeleton reinforced concrete structure is known in the background art (hereinafter referred to as "background art 1"). The metal fitting is made of a steel plate having a convex cross-section and is fixed using a high-strength fiber sheet.

In addition, a structure that uses a pin fitted into a through-hole formed in a beam to fix an antiseismic reinforcement member to the structure is known in the background art (hereinafter referred to as "background art 2").

Furthermore, a structure that uses a through-hole formed in a beam and a PC steel rod to fix a pedestal of an antiseismic reinforcement member to the structure is known in the background art (hereinafter referred to as "background art 3").

In addition, a structure that uses an anchor bolt to fix a metal fitting for connecting an antiseismic reinforcement member to a column and beam, which are made of reinforced concrete, is known in the background art (hereinafter referred to as "background art 4").

In the situation where welding is used on site to fix a reinforcement member to a steel skeleton structure; however, the following problems may arise:

(1) if an improper condition for welding, such as upward-welding or welding that requires an uncomfortable body position, exists, a welding strength having low reliability may result;

(2) an area around the weld has to be protected by covering with proper materials;

(3) if there is a concrete slab formed on the beam, chipping of the concrete may be required to gain access to the underlying steel; and (4) in the case of a preexisting building, the chipping of the concrete cannot be carried out while people are living in and using the building because of the significant noise of chipping the concrete, which leads to a longer time of construction.

Also, in the case of a reinforced concrete structure or a steel skeleton reinforced concrete structure, a steel framework has to be set up in a limited space, which also leads to a longer time of construction.

Furthermore, in the case of a steel skeleton reinforced concrete structure, reinforcing bars inside may be an obstacle to using a long anchor.

In the background art 1, the use of a high-strength fiber sheet increases the cost of construction.

In the background art 2, the method may only be applied to an isolated column. Otherwise the construction would have to be extended to an adjacent area.

In the background art 3, a PC steel rod inserted through the beam is used for fixing a pedestal of the antiseismic reinforcement member to the structure. Therefore, it is necessary to drill the concrete slab to form the through-hole. The drilling causes noise and vibration. Also, a concrete strength that matches the tensile force of the PC steel rod is required.

In the background art 4, the method cannot be applied if the concrete is not thick enough.

With regard to the methods according to the background art for setting up a brace as an antiseismic reinforcement member, as mentioned above, there are known methods that fix the brace by welding on site with respect to a steel skeleton structure and fix the brace after installing a steel framework. However the methods according to the background art experience some difficulty in their application, including noise and dust problems.

The inventor of the present invention has proposed a joint structure for an antiseismic reinforcement member, which enables the problems associated with the joint structures in the background arts 1, 2 and 3 to be avoided. In addition, the time of construction and the cost of connecting can be reduced. Furthermore, the area of construction can be limited to the area in question, so that the adjacent area can be used as usual. It is also possible to provide an increased endurance of the joint.

This prior invention from the present inventor can solve the problems of noise and dust, but cannot ensure a large load-bearing. The reasons that this prior invention cannot ensure a large load-bearing is as follows:

(1) the metal fitting part is directly fixed to the slab concrete;

(2) consequently, a tensile force from the antiseismic reinforcement member causes a tensile force in addition to a shearing force to be applied to the concrete slab; and (3) the concrete slab is locally destroyed at the place where the tensile force is applied.

SUMMARY OF THE INVENTION

An object of the present invention is to provide a joint structure, wherein the metal fitting is not fixed onto the face of a concrete slab. However, a constraining member, independent from the metal fitting, is fixed onto the concrete slab to receive an applied force. This structure enables the brace to bear a large load. Accordingly, the above-mentioned problems can be solved.

In the present specification, the terms "connect," "connecting" or "connected" are used to describe parts that are "fixed" or "joined" to each other. The terms "fix," "fixing" and "fixed" are used to describe parts that are fastened or bonded to each other. Finally, the terms "join," "joining" and "joined" are used to describe parts that are not fixed to each other, but are merely placed on each other.

The above objects of the present invention can be accomplished by a joint structure for antiseismic reinforcement, comprising:

a first structural member, a second structural member, said first and second structural members forming an intersection therebetween;

an antiseismic reinforcement member; and a metal fitting, said metal fitting connecting said antiseismic reinforcement member to the intersection between the first and second structural members, wherein one part of the metal fitting is fixed to the first structural member using a fastener, and another part of the metal fitting is not fixed to the second structural member, and a constraining member is fixed to the second structural member at a location close to or abutting an edge portion of the metal fitting, the constraining member bearing a force applied to the metal fitting.

The above objects of the present invention can also be accomplished by a joint structure for antiseismic reinforcement, comprising:

a straight structural member, a pair of antiseismic reinforcement members; and a metal fitting connecting each of the pair of antiseismic reinforcement members to the straight structural member in a different direction from each other, wherein the metal fitting is not fixed to the straight structural member and a pair of constraining members to bear a force to be applied to the metal fitting is fixed to the straight structural member, each of the pair of constraining members is located close to or abutting opposite edge portions of the metal fitting.

The above objects of the present invention can also be accomplished by a joint structure for antiseismic reinforcement, comprising:

at least one structural member having a longitudinal axis, at least one antiseismic reinforcement member, each antiseismic reinforcement member having a longitudinal axis located in a plane that is generally parallel to the longitudinal axis of the structural member, the longitudinal axis of the antiseismic reinforcement member being inclined with respect to the longitudinal axis of the structural member; and a metal fitting connecting each of the antiseismic reinforcement members to the structural member, wherein the metal fitting is not fixed to the structural member, at least one constraining member is fixed to the structural member close to or abutting an edge portion of the metal fitting, and the constraining member bears a force applied to the metal fitting in a direction generally parallel to the longitudinal axis of the structural member.

According to the present invention, a metal fitting to be connected to two structural members at an intersecting portion thereof is joined to one of the two structural members in the manner where the applied force can be received as a shearing force. Therefore no great tensile force is applied to a slab of the structural member, which makes it possible to effectively transmit the force to a stud connector on the beam to result in a high load bearing force of the concrete slab.

Furthermore, with respect to a steel skeleton structure, a reinforced concrete structure or a steel skeleton reinforced concrete structure, since no chipping of the concrete slab is necessary, there is no harmful effect to the area around the joint structure during assembly. This makes it possible to install the antiseismic reinforcement member while people are using the structure. In addition, it is unnecessary to clean up the area around the joint structure after assembly of the joint structure. Since welding on site, which results in a low reliability of welding strength, is not employed, a more reliable joint structure for antiseismic reinforcement can be provided.

If a size of a gusset plate of the metal fitting is selected to have an appropriate stiffness so as to be able to follow a deformation of the structural member caused by an earthquake, detachment of the metal fitting from the structural member during an earthquake can be prevented. This leads to a joint structure for highly antiseismic reinforcement. This can be applied to any structure such as a steel skeleton structure, a reinforced concrete structure and a steel skeleton reinforced concrete structure.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2(*b*) is a cross-sectional view taken along the line II-II of FIG. 1;

FIG. 2(*c*) is a cross-sectional view taken along the line III-III of FIG. 2(*a*);

FIG. 4(*b*) is a cross-sectional view taken along the line V-V of FIG. 3;

FIG. 6(*b*) is a cross-sectional view taken along the line VII-VII of FIG. 5;

FIG. 8(*b*) is a cross-sectional view taken along the line IX-IX of FIG. 7;

DETAILED DESCRIPTION OF THE PREFERRED EMBODIMENT

The present invention will now be described with reference to the accompanying drawings.

Figure 1:
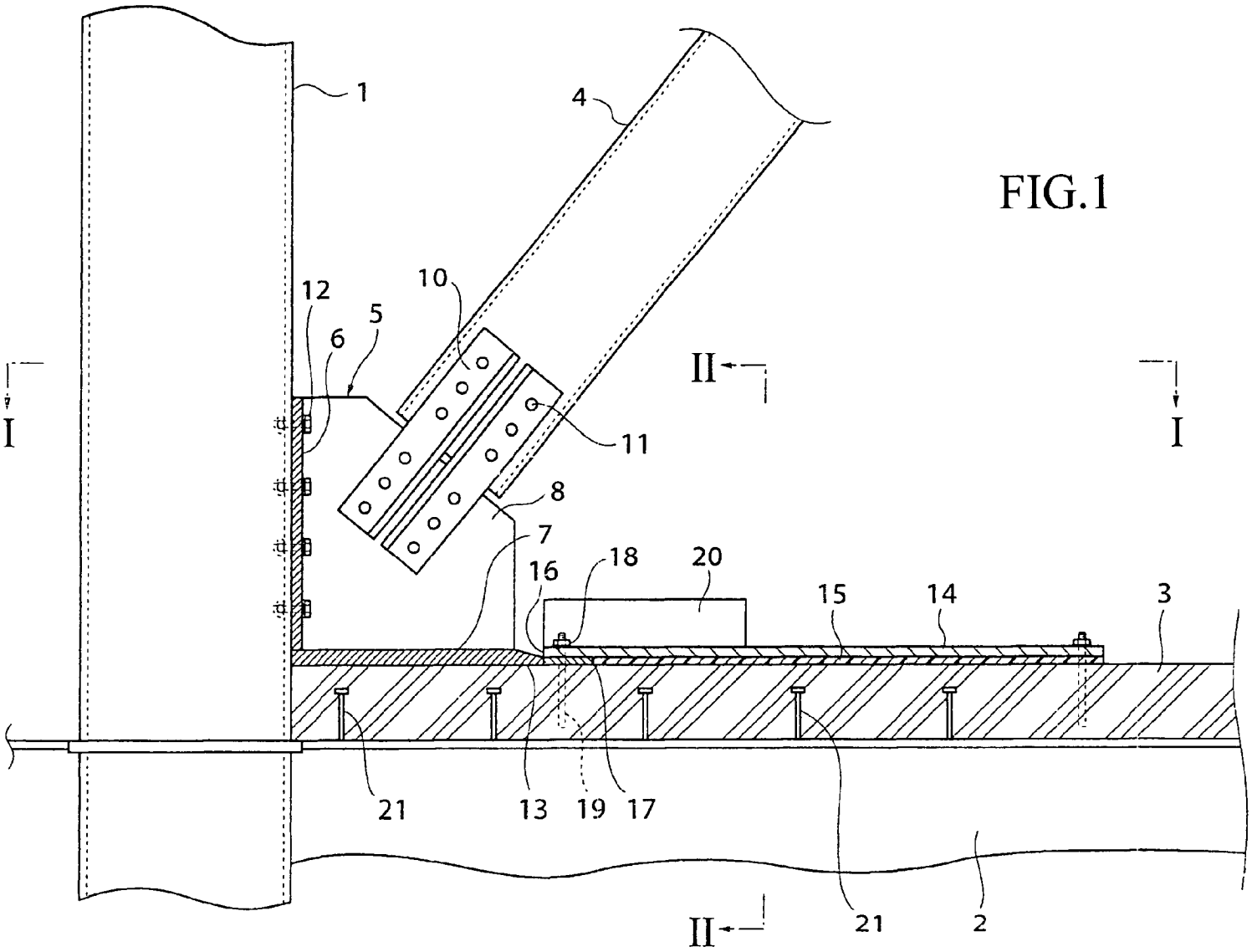
FIG. 1 is a cross-sectional view of a first embodiment of the present invention.
Figure 2A:
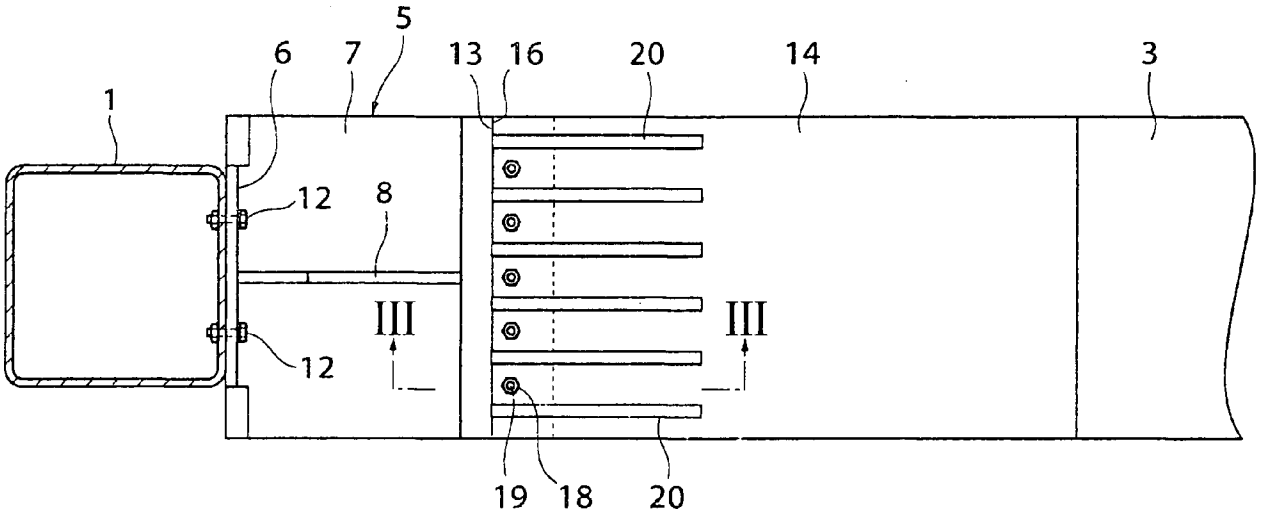
FIG. 2(*a*) is a cross-sectional view taken along the line I-I of FIG. 1.
Figure 2C:
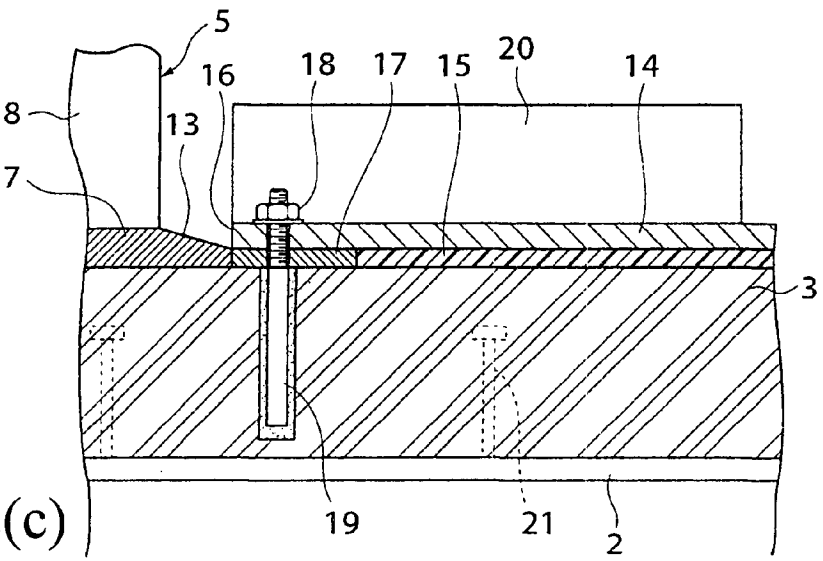
Figure 2B:
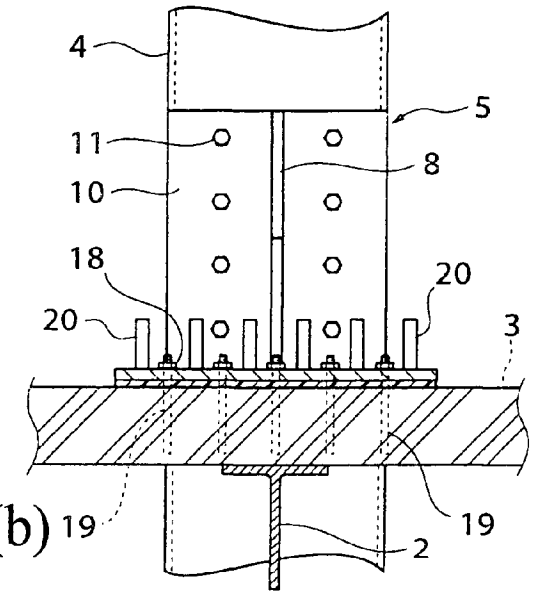

FIGS. 1 and 2 illustrate the first embodiment of the present invention, where an antiseismic reinforcement is connected at the intersection of two structural members. The two structural members are a column 1 made of a square steel tube and a beam 2 made of an H-shaped steel beam having a concrete slab 3 formed thereon. A metal fitting 5 is used to connect an antiseismic reinforcement member 4, such as a brace, at an intersection between the column 1 and the beam 2. The metal fitting 5 includes a first plate 6 that is fixed to a face of the column 1, a second plate 7 that is placed on the concrete slab 3 and a gusset plate 8 that is welded to the first plate 6 and the second plate 7, respectively, in the perpendicular direction. The antiseismic reinforcement member 4 is fixed via a splice plate 10 to the gusset plate 8 using bolts 11.

The first plate 6 of the metal fitting 5 is fixed to the column 1 with a plurality of high-tensile bolts 12. However the second plate 7 is merely placed on the upper face of the concrete slab 3, but is not fixed thereto. In other words, the second plate 7 is joined to the upper face of the concrete slab 3. The second plate 7 is not fixed to the upper face of the concrete slab 3. In the background art, the metal fitting 5 is used to transmit a tensile force applied to the antiseismic reinforcement member 4, due to an earthquake or the like, to the column 1 and the beam 2 through the concrete slab 3. Therefore, in the background art, the metal fitting 5 would be fixed to both of the column 1 and the beam 2. In the first embodiment of the present invention; however, the second plate 7 is merely placed on or joined to the concrete slab 3. Therefore, the metal fitting 5 cannot transmit a tensile force from the antiseismic reinforcement member 4 to the concrete slab 3 and to the beam 2 through a stud bolt 21 on the beam 2.

The tensile force from the antiseismic reinforcement member 4 applied to the metal fitting 5 can be divided into a vertical component force in the direction of lifting the metal fitting and a horizontal component force in the lateral direction. In view of this, in the first embodiment of the present invention, the vertical component force is designed to be transmitted to the column 1 by fixing the first plate 6 to the column 1 using the high-tensile bolts 12. The horizontal component force is designed to be transmitted to the beam 2 as an axial force through the concrete slab 3 and the stud bolt 21 by setting a constraining member on the concrete slab 3 which can counteract the horizontal component force.

More specifically, a constraining member 14 that is made of a steel plate is bonded on the concrete slab 3 very close to or abutting an edge portion 13 of the second plate 7. The constraining member 14 is made of a rectangular steel plate having a proper size (area) and thickness and being fixed with an adhesive 15, such as an epoxy-resin-based adhesive, on the upper face of the concrete slab 3. It is preferable for the levels of both edge portions 13 and 16 of the second plate 7 and the constraining member 14, respectively, to be the same, so that the edge portion 16 of the constraining member 14 bears the horizontal force provided to the edge portion 13 of the second plate 7. However, if the height of each of the edge portions 13 and 16 is different from each other due to a thickness of the adhesive 15, a spacer 17 made of a metal plate should be bonded underneath the edge portion 16 of the constraining member 14.

A tensile force applied to the antiseismic reinforcement member 4 due to an earthquake causes a vertical force to the first plate 6 and horizontal force to the second plate 7 of the metal fitting 5. The vertical force is received by the column 1 through the high-tensile bolt 12 fixing the first plate 6 to the column 1, and the horizontal force applied to the second plate 7 is received by the constraining member 14 and is transmitted to the beam 2 as an axial force through the adhesive 5, concrete slab 3 and the stud bolt 21 on the beam 2 to be borne by the concrete slab 3. The horizontal force causes a shearing force in the adhesive 15.

When the horizontal force acts on the second joining plate 7 while fixing the first joining plate 6 on the column 1 with the high-tensile bolt 12, an upward moment around the bolt fixing portion as a rotation center works on the edge portion 13 of the second joining plate 7. To counter this upward moment, a post-construction anchor 19 is embedded in the concrete slab 3. A screw part of the post-construction anchor 19 extends out of the concrete slab 3 at a location close to the edge portion 16 through the spacer 17. The screw part is fastened with a nut 18.

One type of post-construction anchor 19 is a chemical anchor. In order to use a chemical anchor, the concrete slab 3 is drilled to form a hole. Two kinds of capsules, each of which contains one component of a two-component-mixing-type fixing agent, are put in the hole. The bolt is then inserted into the hole to break the capsules, mix the two components and fix the bolt on the concrete slab 3 when the fixing agent solidifies. Another type of post-construction anchor 19 is a mechanical anchor. In this type of anchor, an expansion portion expands in a hole drilled in the concrete slab 3 by pushing a bolt thereinto to anchor the bolt in the concrete slab 3.

The use of a post-construction anchor can reliably prevent the edge portion 16 of the constraining member 14 from being bent upward from the upward moment of the edge portion 13 of the second joining plate 7. Furthermore, stiffening ribs 20 are set on the upper face of the edge portion 16 of the constraining member 14 to prevent the edge portion 16 of the constraining member 14 from being locally bent upward. A height and width of the stiffening rib 20, and the number of the stiffening ribs 19 are determined in terms of the necessary stiffness.

According to the aforementioned joint structure for antiseismic reinforcement, the horizontal force, caused by a tensile force from the antiseismic reinforcement member 4, applied to the metal fitting 5 can be borne as an axial force in the concrete slab 3 and a shearing force in the adhesive 15. Therefore, a tensile force is not locally applied to the concrete of the concrete slab 3 unlike the structure according to the background art, which prevents the concrete slab 3 from being destroyed during an earthquake, for example.

When a compressive force is experienced by the antiseismic reinforcement member 4, the force applied to the metal fitting 5 can be transmitted to a structural member (column 1) as a bearing force, since one side of the metal fitting 5 opposite the constraining member 14 abuts the structural member (column 1) in the first embodiment.

Figure 3:
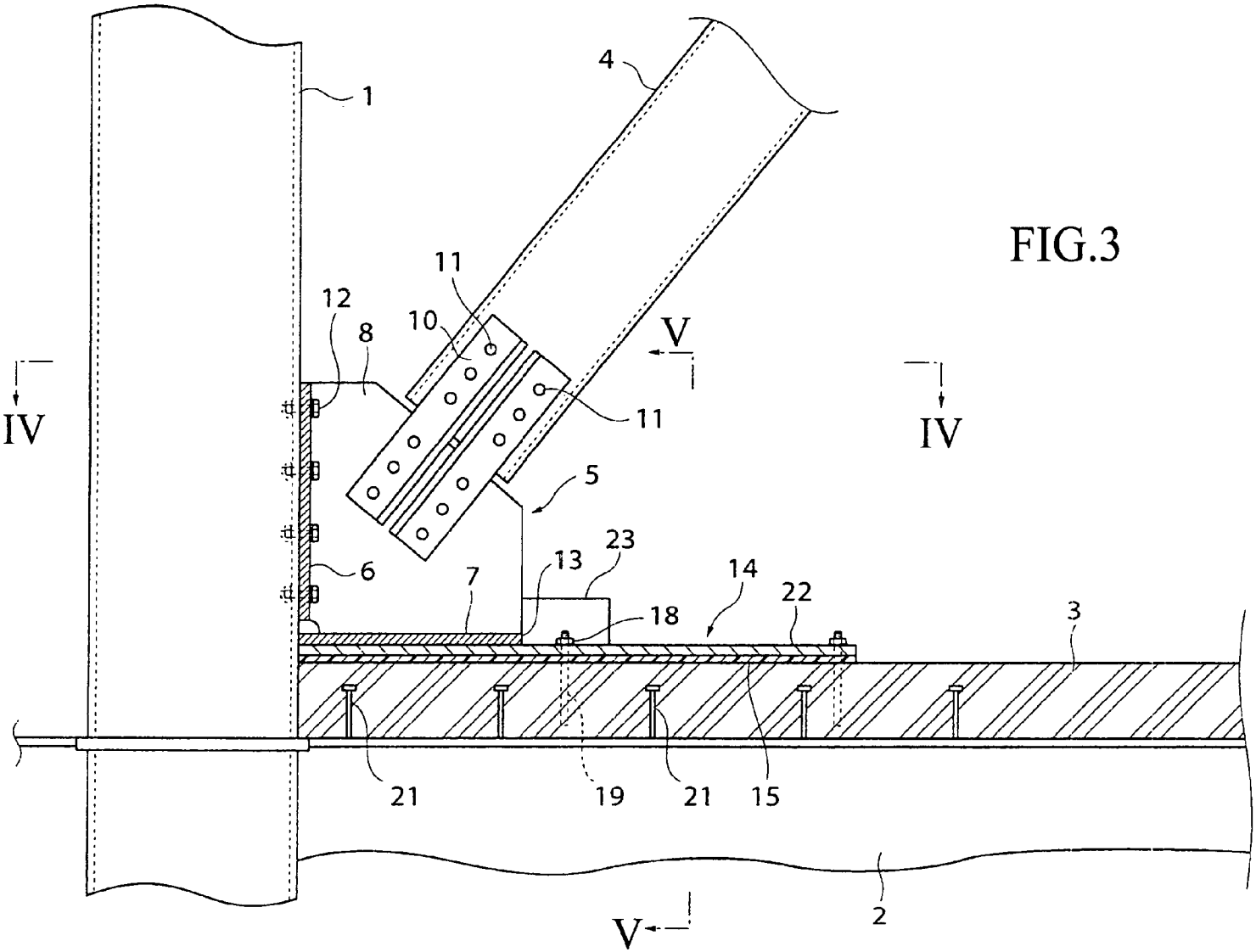
FIG. 3 is a cross-sectional view of a second embodiment of the present invention.
Figure 4B:
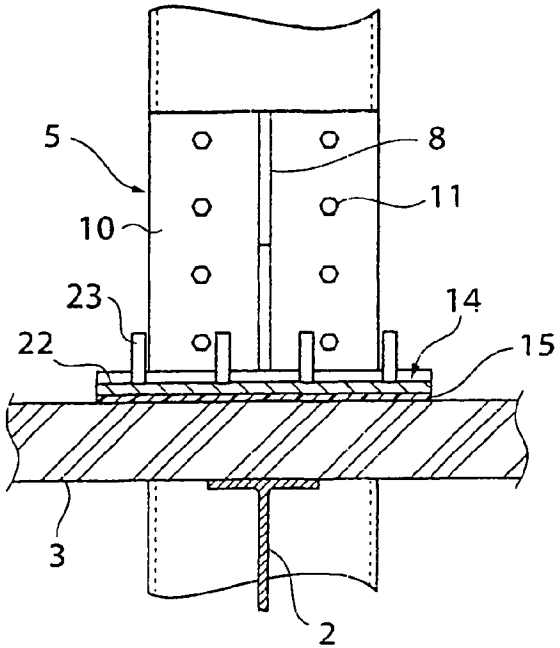
FIG. 4(*a*) is a cross-sectional view taken along the line IV-IV of FIG. 3.
Figure 4A:
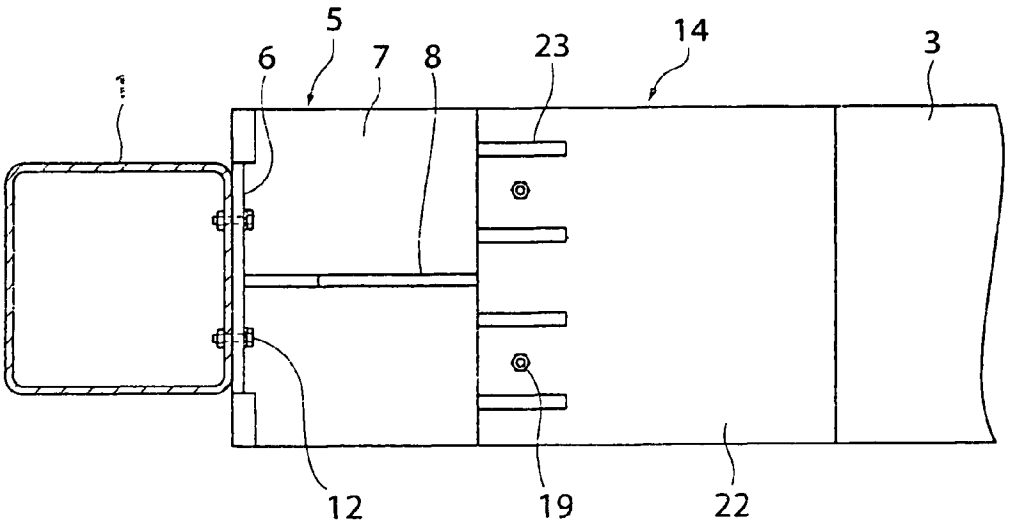

FIGS. 3 and 4 illustrate the second embodiment of the present invention. In this embodiment, a constraining member 14 comprises a base plate 22, which is fixed to the concrete slab 3 with the adhesive 15. In addition, a constraining plate 23 is formed on the base plate 22 located close to the edge portion 13 of the second plate 7. The base plate 22 extends underneath the second plate 7 to the corner formed at the intersection between the column 1 and the beam 2 with the concrete slab 3. The second plate 7 is not fixed to the base plate 22; the second plate is merely placed on the base plate 22. The constraining plate 23 counteracts an upward force from the second plate 7. To prevent the base plate 22 from lifting, a screw part of the post-construction anchor 19 extending out of the base plate 22 at a location close to the constraining plate 23 is fastened with a nut 18. The other aspects of the second embodiment are the same as in the first embodiment of the present invention.

According to the second embodiment of the present invention, the horizontal force, caused by a tensile force from the antiseismic reinforcement member 4, applied to the metal fitting 5 can be borne as an axial force in the concrete slab 3 and a shearing force in the adhesive 15. Therefore, a tensile force from the antiseismic reinforcement member 4 is not locally applied to the concrete of the concrete slab 3. In view of this, the concrete slab 3 is prevented from being destroyed.

Figure 5:
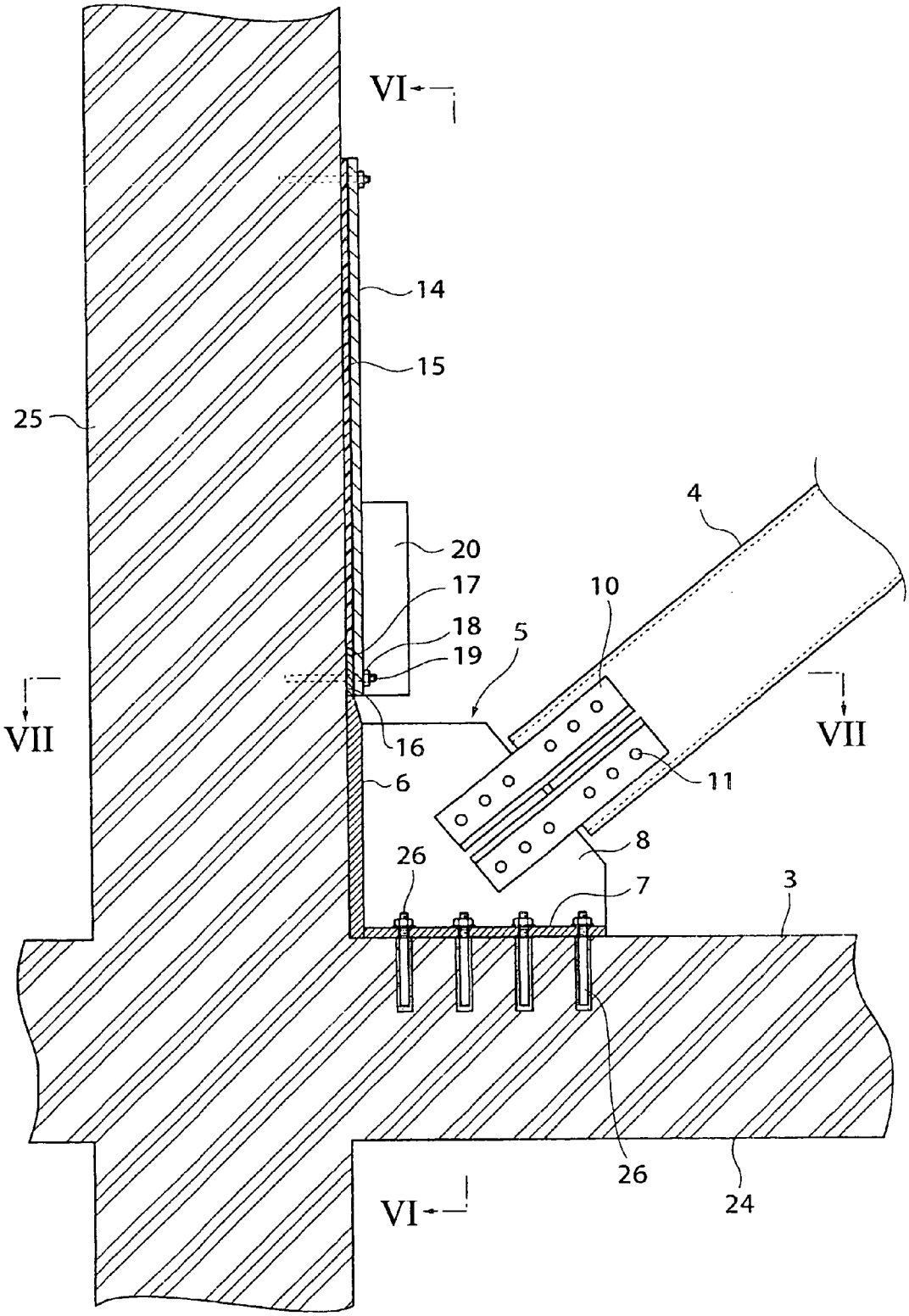
FIG. 5 is a cross-sectional view of a third embodiment of the present invention.
Figure 6A:
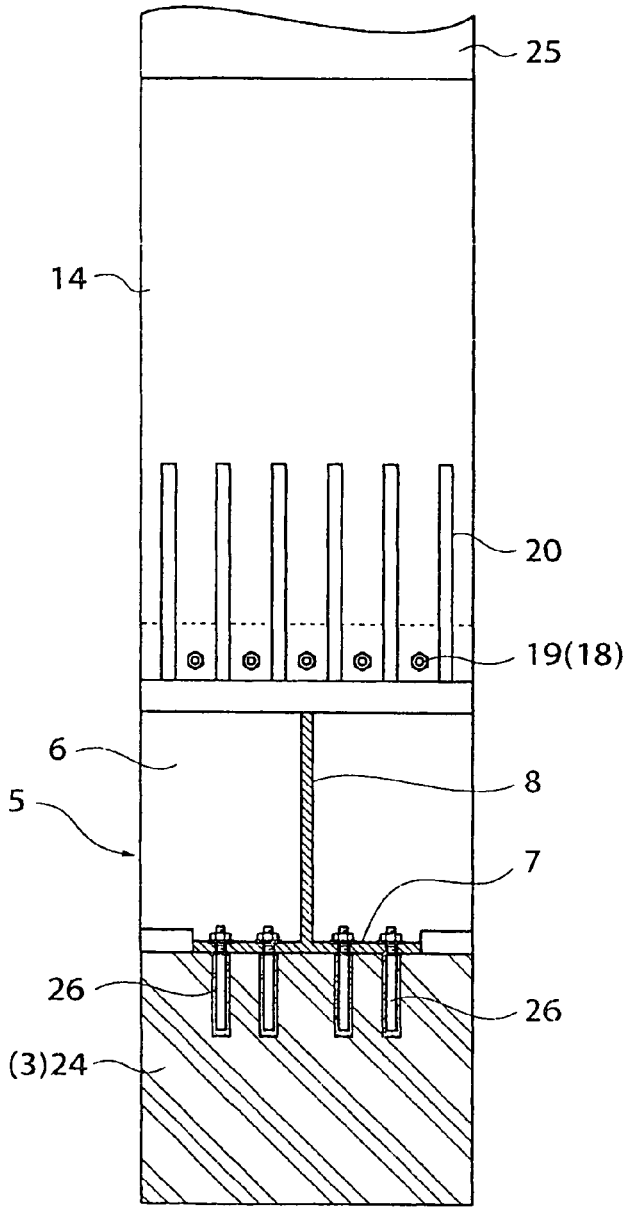
FIG. 6(*a*) is a cross-sectional view taken along the line VI-VI of FIG. 5.
Figure 6B:
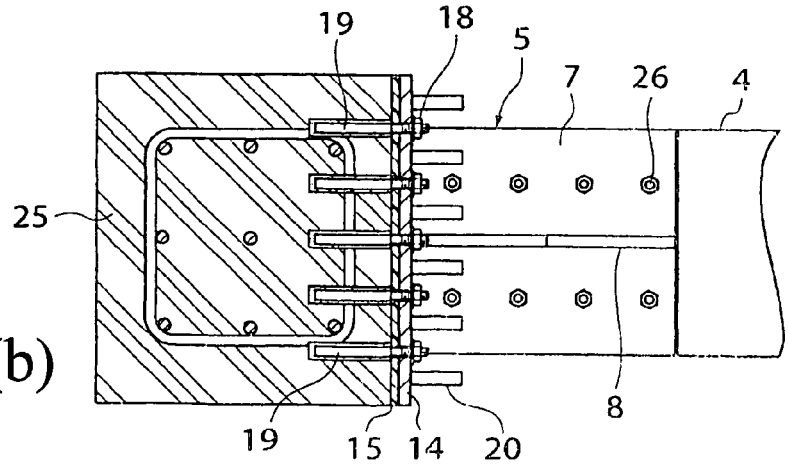
Figure 7:
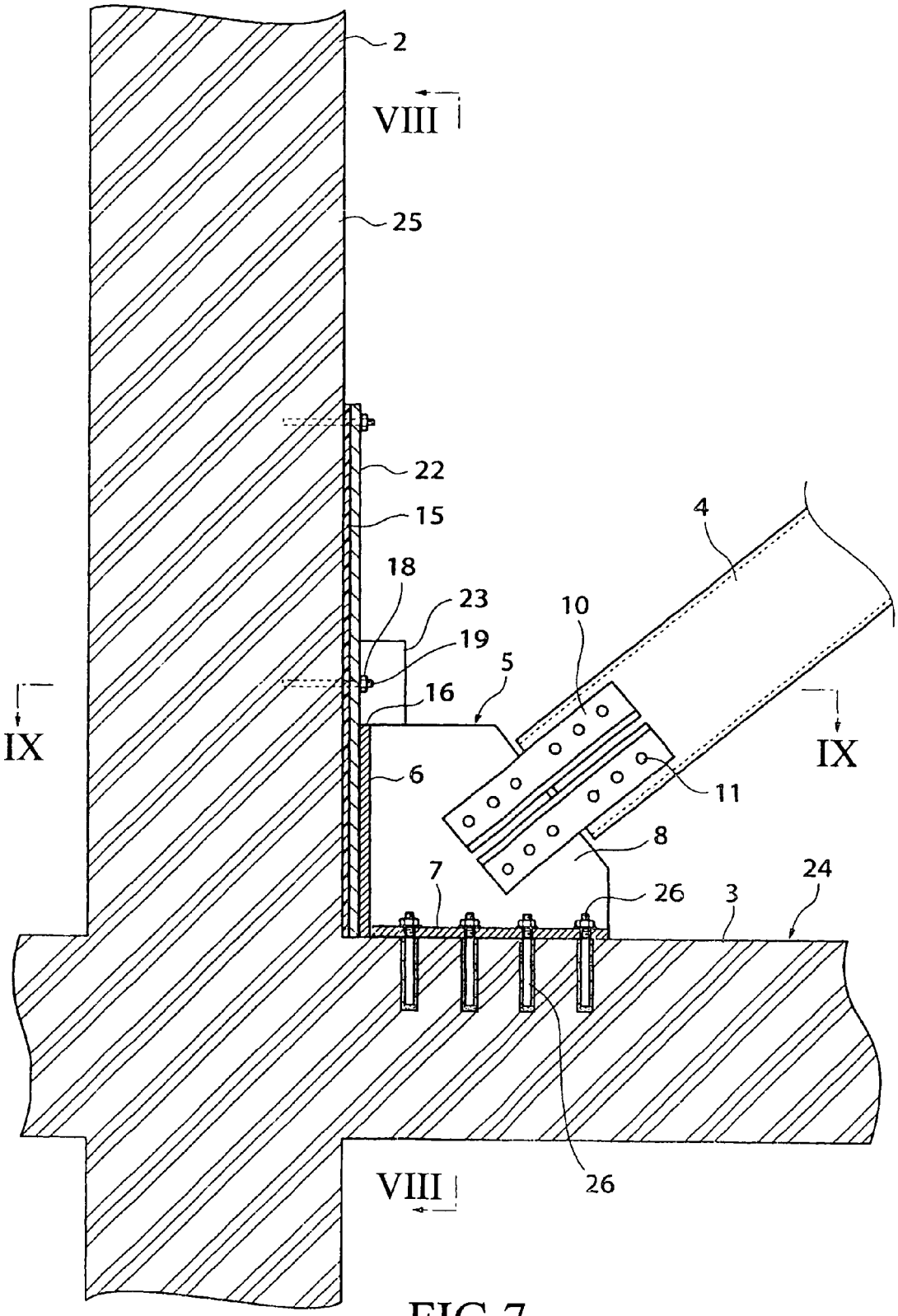
FIG. 7 is a cross-sectional view of a fourth embodiment of the present invention.
Figure 8A:
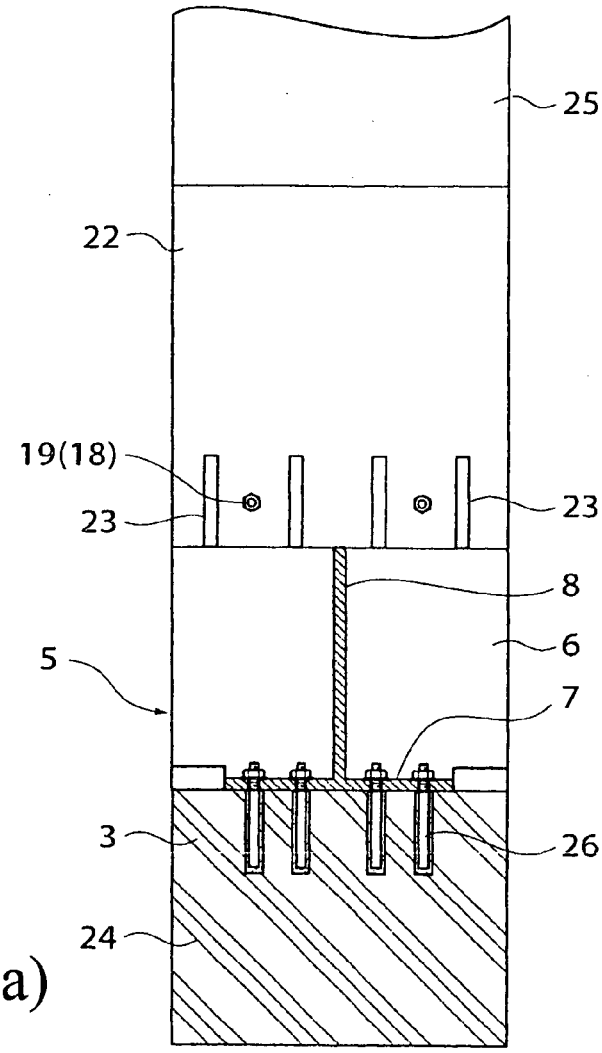
FIG. 8(*a*) is a cross-sectional view taken along the line VIII-VIII of FIG. 7.
Figure 8B:
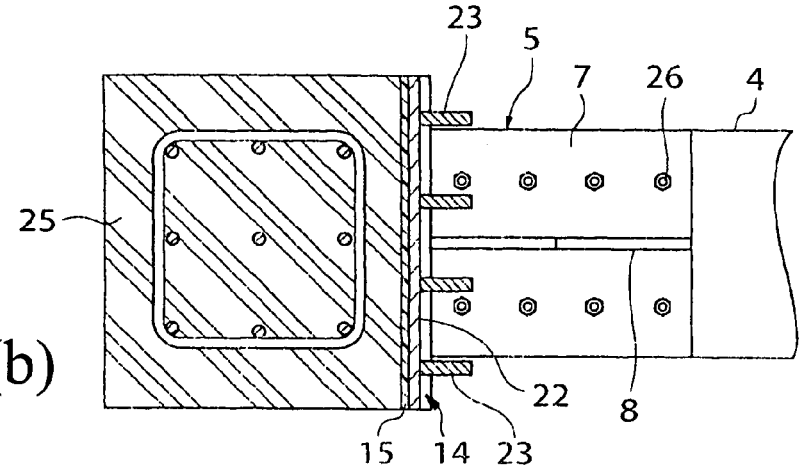
Figure 9:
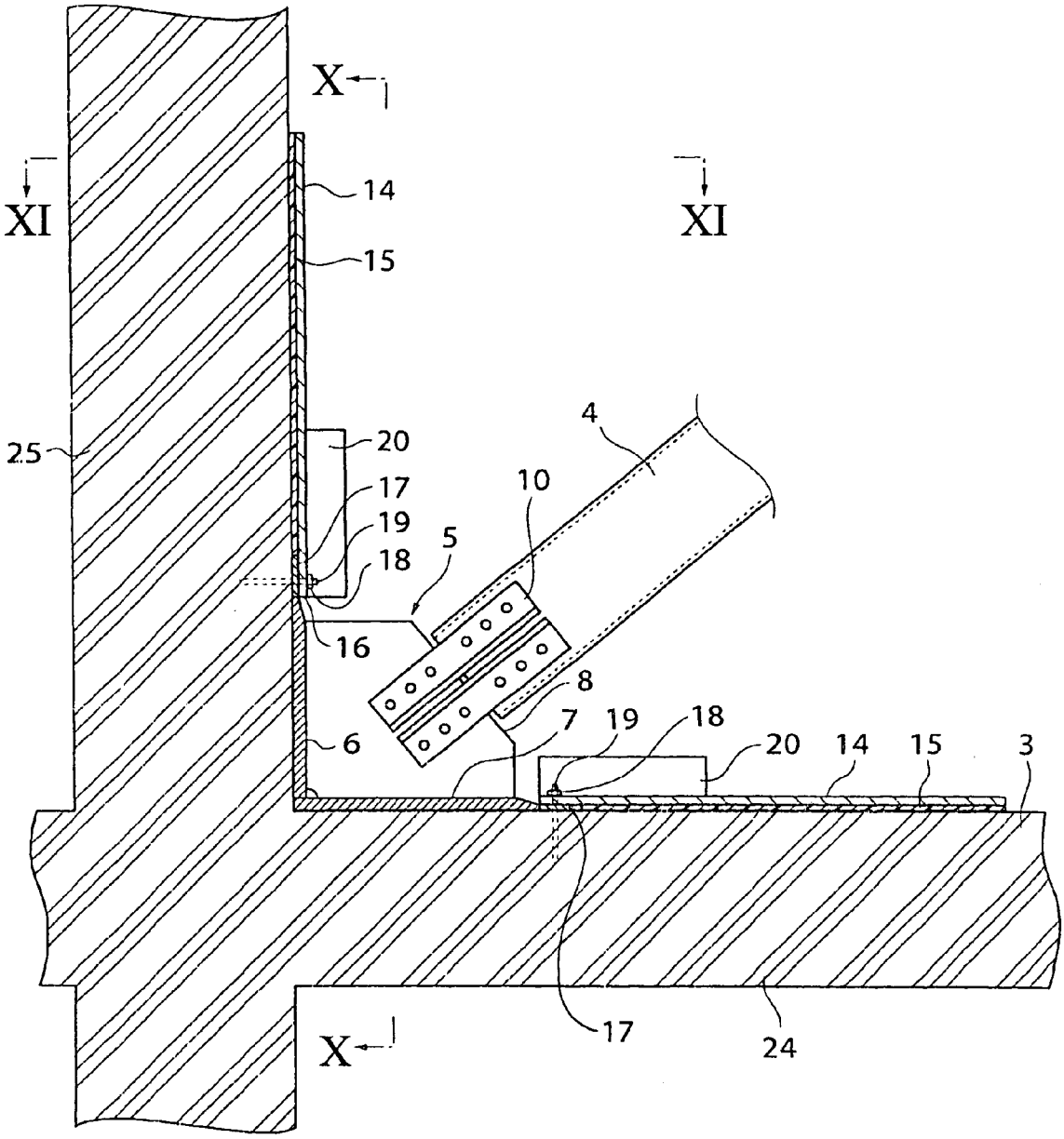
FIG. 9 is a cross-sectional view of a fifth embodiment of the present invention.
Figure 10:
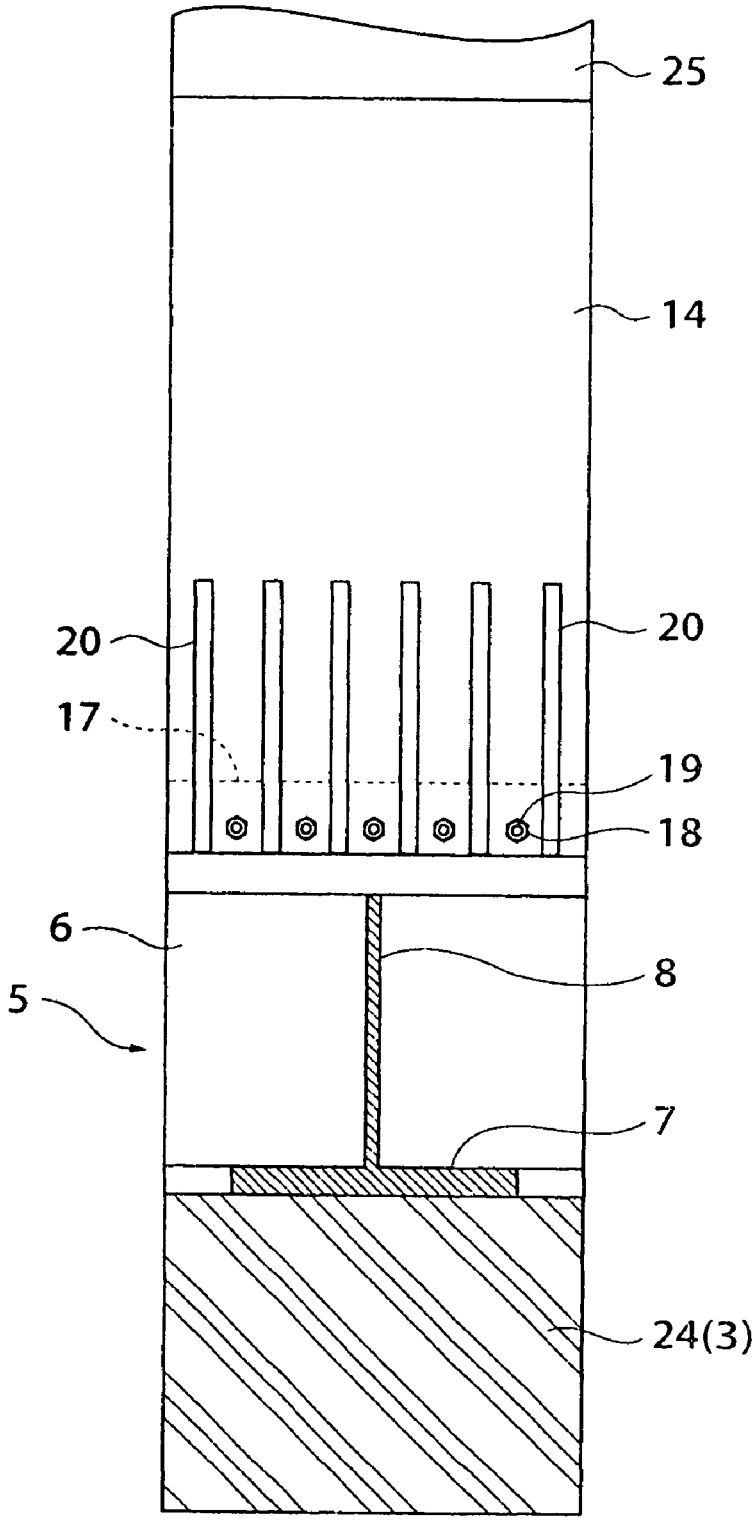
FIG. 10 is a cross-sectional view taken along the line X-X of FIG. 9.
Figure 11:
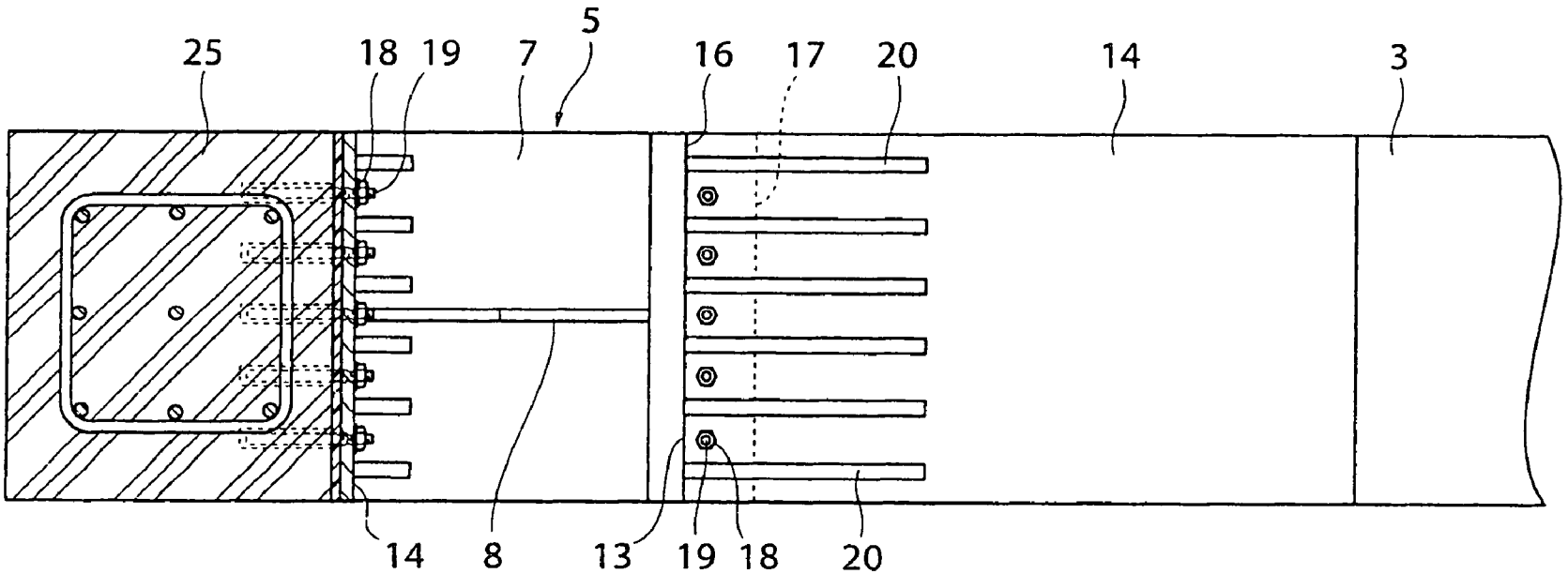
FIG. 11 is a cross-sectional view taken along the line XI-XI of FIG. 9.

FIGS. 5 and 6 illustrate the third embodiment of the present invention, FIGS. 7 and 8 illustrate the fourth embodiment of the present invention and FIGS. 9, 10 and 11 illustrate the fifth embodiment of the present invention, respectively. Each of the third, fourth and fifth embodiments illustrate examples where each of the joint structures for antiseismic reinforcement in the first and second embodiments is applied to a reinforced concrete structure. In the third and fourth embodiments, one of plates of the metal fitting 5 is fixed to the concrete slab 3 and the other is not fixed to the column 1. Therefore, the elements of the third and fourth embodiments have an opposite positional relationship compared to the embodiments 1 and 2. Specifically, the location of the fixed plate of the metal fitting 5 is located on the beam 2, instead of the column 1. Furthermore, in the third embodiment of FIGS. 5 and 6, the not-fixed joint structure of the first embodiment is applied and in the fourth embodiment of FIGS. 7 and 8, the not-fixed joint structure of the second embodiment is applied. Hereinafter, the recitation "not fixed" means "placed but not fixed," and the recitation "not-fixed joint structure" means a joint structure that uses a part that is not directly fixed to the underlying column or beam. In other words, two parts that are "not fixed" to each other are "joined" to each other.

In the third embodiment of FIGS. 5 and 6, the second plate 7 of the metal fitting 5 is fixed to a reinforced concrete beam 24 or a concrete slab 3 using a post-construction anchor 26 such as the chemical anchor. Described above. The first plate 6 of the metal fitting 5 is not fixed to a side face of the reinforced concrete column 25. However, a constraining member 14 with a stiffening rib 20, which is the same as in the first embodiment, is fixed to the reinforced concrete column 25 with an adhesive 15.

According to the third embodiment, the vertical force caused from the antiseismic reinforcement member 4 applied to the metal fitting 5 can be borne by the constraining member 14 fixed to the reinforced concrete column 25 via the first plate 6. Therefore, a tensile force is not locally applied to the concrete of the reinforced concrete column 25. This prevents the concrete from being destroyed.

In the fourth embodiment of FIGS. 7 and 8, the second plate 7 of the metal fitting 5 is fixed to a reinforced concrete beam 24 or a concrete slab 3 using a post-construction anchor 26 such as a chemical anchor. The first plate 6 of the metal fitting 5 is not fixed to a side face of the reinforced concrete column 25. As in the second embodiment, the base plate 22 extends underneath the first plate 6 to reach the corner formed at the intersection between the column and beam (the concrete column 25 and concrete beam 24). The base plate 22 is fixed to the reinforced concrete column 25 with the adhesive 15 and has a constraining plate 23 formed thereon located close to the edge portion 16 of the first plate 6. The constraining plate 23 counteracts the vertical force applied to the first joining plate 6. To prevent the base plate 22 from lifting locally away from the concrete column 25, a screw part of a post-construction anchor 19 that extends out of the base plate 22 at a location close to the constraining plate 23 is fastened with a nut 18.

According to the fourth embodiment, the vertical force caused from the antiseismic reinforcement member 4 applied to the metal fitting 5 can be borne by the constraining plate 23 fixed to the reinforced concrete column 25 via the first plate 6. Therefore, a tensile force is not locally applied to the concrete of the reinforced concrete column 25. This prevents the concrete from being destroyed.

FIGS. 9, 10 and 11 illustrate the fifth embodiment of the present invention. The fifth embodiment illustrates an example where a reinforced concrete structure made of a reinforced concrete column 25 and a reinforced concrete beam 24 include a metal fitting 5 having a not-fixed joint structure applied to both the column 25 and the beam 24. That is, the first plate 6 and the second plate 7 of the metal fitting 5 are not fixed to the side face of the reinforced concrete column 25 and the upper face of the concrete slab 3, respectively. The not-fixed joining structure between the first joining plate 6 and the reinforced concrete column 25 is the same as the not-fixed joining structure illustrated in FIG. 5 of the third embodiment. More specifically, with respect to the first plate 6, a spacer 17 is located very close to or abutting an edge of the first plate 6 and a constraining member 14 with a stiffening rib 20 is fixed to the reinforced concrete column 25 using an adhesive 15. A post-construction anchor 19 extends through the spacer 17 and is fastened by a nut 18. Likewise, with respect to the second joining plate 7, a spacer 17 is located very close to or abutting an edge of the second plate 7 and a constraining member 14 with a stiffening rib 20 is fixed to the concrete slab 3 using an adhesive 15. A post-construction anchor 19 extends through the spacer 17 and is fastened by a nut 18.

According to the fifth embodiment, a tensile force applied on the antiseismic reinforcement member 4 due to an earthquake causes a vertical force with in the first plate 6 and horizontal force in the second plate 7 of the metal fitting 5. The vertical force is received by the constraining member 14 fixed on the reinforced concrete column 25 from the first plate 6 and is further transmitted to the reinforced concrete column 25 as an axial force via the adhesive 15. The adhesive 15 experiences a shearing force when transferring the vertical force to the reinforced concrete column 25. In addition, the horizontal force is received by the constraining member 14 fixed on the concrete slab 3 from the second joining plate 7. The horizontal force is transmitted to the concrete slab 3 as an axial force via the adhesive 15. The adhesive 15 experiences a shearing force when transferring the vertical force to the concrete slab 3. Therefore, a tensile force is not locally applied to the concrete of the reinforced concrete column 25 or the concrete slab 3. This prevents the concrete from being destroyed.

A sixth embodiment of the present invention will be described below, wherein the same or similar elements in the first to fifth embodiments will be identified by using the same reference numerals.

Figure 12:
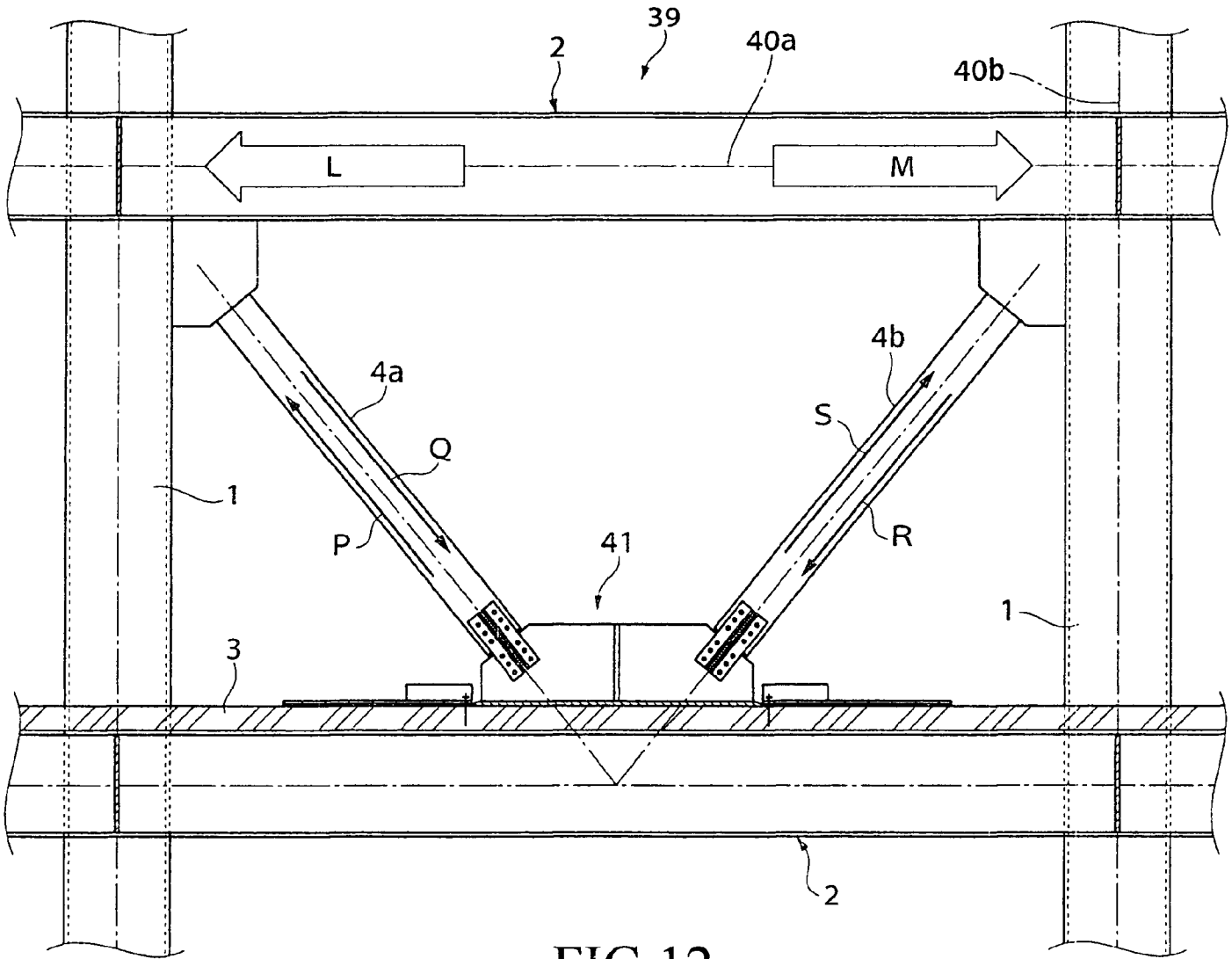
FIG. 12 illustrates a joint structure for an antiseismic reinforcement member according to a sixth embodiment of the present invention.

As shown in FIG. 12, a steel skeleton structure 39 includes columns 1 erected at certain intervals and beams 2 bridged between the columns 1. A metal fitting (joint structure) 41 is used to connect an antiseismic reinforcement member 4*a* to another antiseismic reinforcement member 4*b*. The first antiseismic reinforcement member 4*a* extends in a diagonally right direction from a diagonal point 40*a* made by the column I and beam 2. The other antiseismic reinforcement member 4*b* extends in a diagonally left direction from the diagonal point 40*b* made by column 1 and beam 2.

In this steel skeleton structure 39, when the upper beam 2 moves toward the L (arrow L) direction relative to the lower beam 2 in FIG. 12 due to an earthquake, a tensile force is applied to the antiseismic reinforcement member 4*a* and a compressive force is applied to the antiseismic reinforcement member 4*b*. This results in a force in the P (arrow P) direction being applied to the joint structure 41 and the force toward the R (arrow R) direction being applied to the joint structure 41. However, since a vertical component force in the P direction and in the R direction cancel one another out, only a horizontal force is applied to the joint structure 41.

Likewise when the upper beam 2 moves toward the M (arrow M) direction relative to the lower beam 2 in FIG. 12 due to an earthquake, a compressive force is applied to the antiseismic reinforcement member 4*a* and a tensile force is applied to the antiseismic reinforcement member 4*b*, which results in the force in the Q (arrow Q) direction being applied to the metal fitting (joint structure) 41 and the force in the S (arrow S) direction being applied to the metal fitting (joint structure) 41. In a similar manner to that described above with regard to the beam 2 moving in the L direction, the vertical component forces cancel one another out, leaving only a horizontal force being applied to the joint structure 41.

Figure 13:
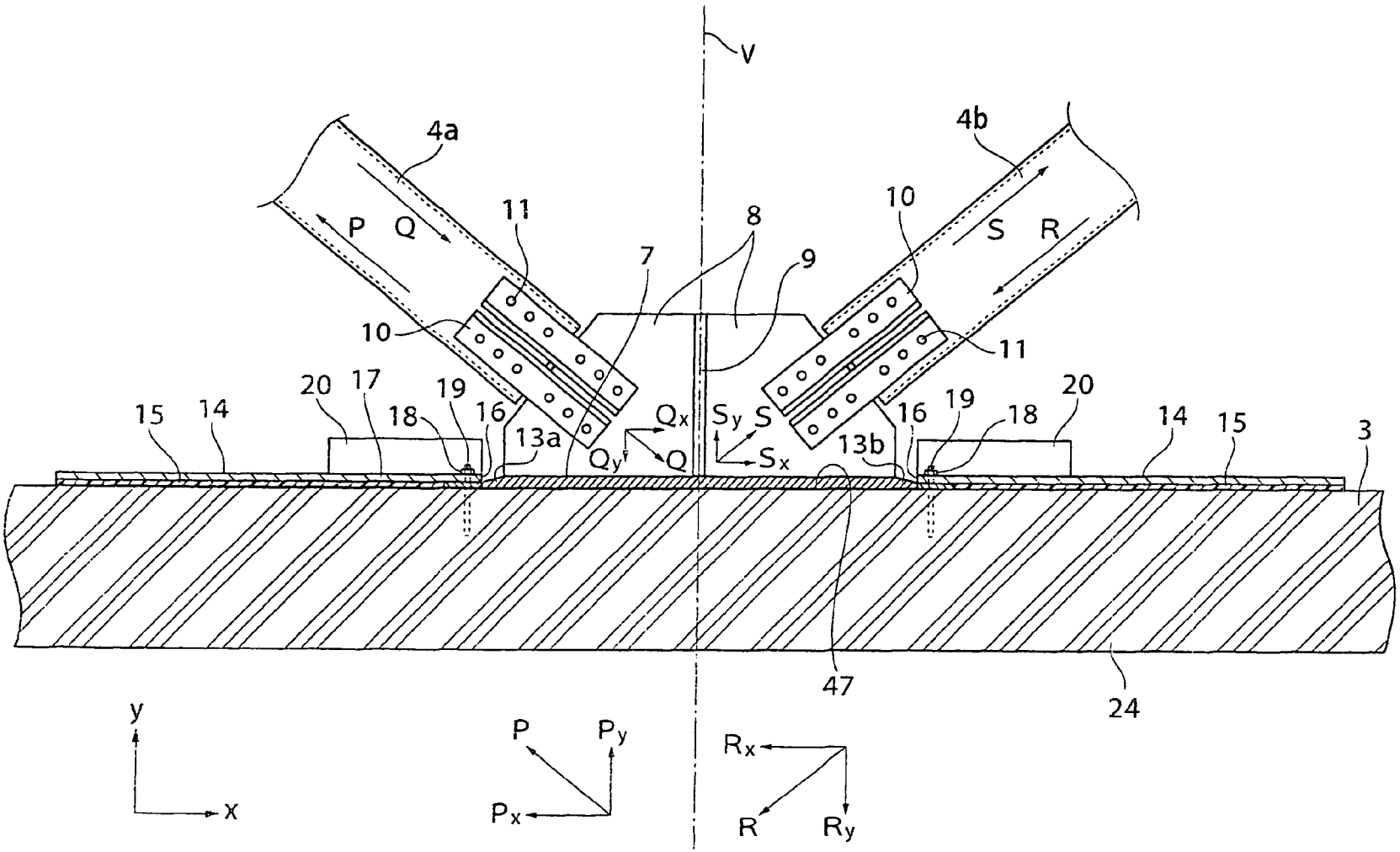
FIG. 13 is an explanatory diagram of a detailed joint structure for the antiseismic reinforcement member according to the sixth embodiment of the present invention.

FIG. 13 describes the details of the joint structure 41. The metal fitting (joint structure) 41 includes a plate 47 placed on a concrete slab 3 and a gusset plate 8 welded orthogonally to the joining plate 47. The antiseismic reinforcement member 4*a* is connected via a splice plate 10 to the gusset plate 8 using bolts 11. Likewise, the antiseismic reinforcement member 4*b* is connected via a splice plate 10 to the gusset plate 8 using bolts 11. The gusset plate 8 has a guiding rib (9) (the guiding rib 9 on the far side is not shown) on both sides.

Constraining members 14 and 14 that are made of a steel plate are respectively located close to or abutting on edge portions 13*a* and 13*b*, respectively, of the plate 47. The constraining members 14 are respectively fixed via an adhesive 15 such as an epoxy-resin-base adhesive onto an upper face of the concrete slab 3.

Thus, the constraining members 14 and 14 immobilize the plate 47. Therefore, when a horizontal force acts on the plate 7, an upward moment is applied to the edge portion of the constraining member 14. To counter this upwards moment, a post-construction anchor 19 is embedded in the concrete slab 3. A screw part of the anchor 19 extends out at a location close to the edge portion 16 and is fastened with a nut 18.

When the movement of the beam 2 towards the L arrow direction causes the tensile force P to be applied to the metal fitting (joint structure) 41 via the antiseismic reinforcement member 4*a* as described above, the tensile force P can be divided into two components of force. Specifically, a Px component force in the x direction and a Py component force in the y direction as shown in FIG. 13. Likewise, the compressive force R applied to the metal fitting (joint structure) 41 via the antiseismic reinforcement member 4*b* can be divided into an Rx o component force in the x direction and a Ry component force in the y direction.

It is understood that Py and Ry cancel one another out and Px and Rx are added together. Therefore, when the beam 2 moves in the L arrow direction, a horizontal force that is equal to the sum of Px and Rx is applied via the edge portion 13*a* to the constraining member 14. Since the constraining member 14 is fixed to the concrete slab 3 with an adhesive 15, the horizontal force is received as a shearing force to the slab face and can be transmitted via the stud on the beam to the beam as an axial force.

Therefore, a tensile force is not locally applied to the concrete slab 3 unlike in the joint structure according to the background art. This prevents the concrete slab 3 from being destroyed.

When the movement of the beam 2 toward the M arrow direction causes the tensile force S to be applied to the joint structure 41 via the antiseismic reinforcement member 4*b* as described above, the tensile force S can be divided into two components of force. Specifically, an Sx component force in the x direction and an Sy component force in the y direction as shown in FIG. 13. Likewise, the compressive force Q applied to the joint structure 41 via the antiseismic reinforcement member 4*a* can be divided into a Qx component force in the x direction and a Qy component force in the y direction.

It is understood that Sy and Qy cancel one another out and Sx and Qx are added together. Therefore, when the beam 2 moves in the L arrow direction, a horizontal that is equal to the sum of Sx and Qx is applied via the edge portion 13*b* to the constraining member 14. Since the constraining member 14 is fixed to the concrete slab 3 with an adhesive 15, the horizontal force is received as a shearing force to the slab face and can be transmitted via the stud on the beam to the beam as an axial force.

Therefore, a tensile force is not locally applied to the concrete slab 3 unlike in the background art joint structure. This prevents the concrete slab 3 from being destroyed.

It is preferable that each of the elements included in the joint structure 41 is formed symmetrical about line V if an angle formed by the antiseismic reinforcement member 4*a* and the concrete slab 3 is equal to an angle formed by the antiseismic reinforcement member 4*b* and the concrete slab 3. However, if the two angles are different, and the elements cannot be formed symmetric, a length of one constraining member 14 can be set different from a length of another constraining member 14 so that the degree of shearing force each adhesive 15 can bear is optimized.

Figure 14:
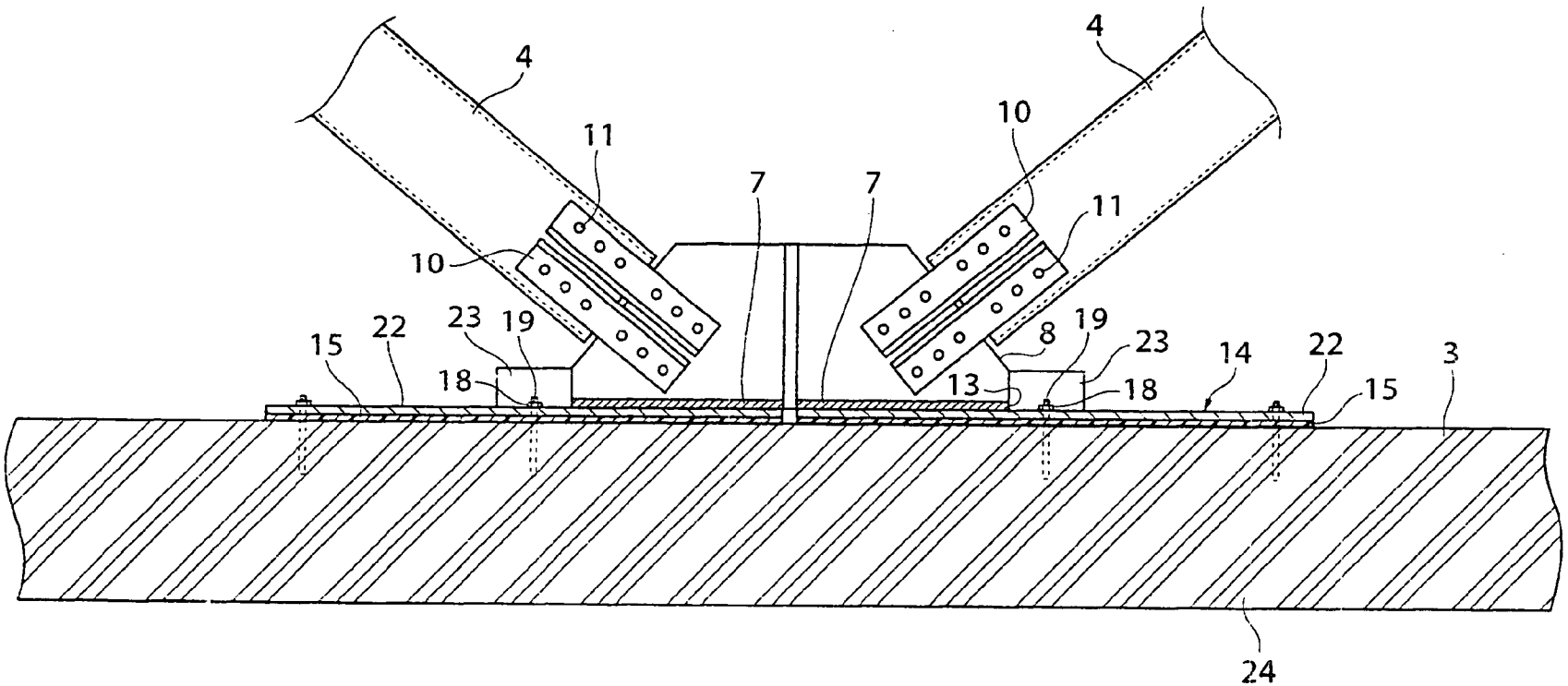
FIG. 14 is an explanatory diagram of another detailed joint structure for the antiseismic reinforcement member according to the sixth embodiment of the present invention.

A variation of the sixth embodiment 6 is shown in FIG. 14 where a constraining member 14 includes a base plate 22, which is fixed to the concrete slab 3 with the adhesive 15. Constraining plates 23, 23 are formed on the base plate 22 located close to the edge portions 13*a* and 13*b*, respectively, of the plate 47. The base plate 22 extends underneath the joining plate 47. The variation of the sixth embodiment will not be further described, since the operation is the same as the second embodiment.

In FIG. 14, a horizontal force applied to the metal fitting 41 caused by a tensile stress and a compressive stress from the antiseismic reinforcement member 4 can be received as a shearing force applied to the adhesive 15. Therefore, a tensile force of the antiseismic reinforcement member 4 is not locally applied to the concrete slab 3 unlike in the background art joint structure. This prevents the concrete slab 3 from being destroyed.

It should be noted that although in the above-described sixth embodiment, the joint structure of the present invention is applied to a concrete slab 3 cast on a beam 2 of a steel skeleton structure 39, the invention is not limited to the above-described one but can be applied to any straight structural member.

Furthermore, it should be noted that although in the above-described sixth embodiment, the joint structure of the present invention is applied to a steel skeleton structure 39, the invention is not limited to the steel skeleton structure but can be applied, for example, to an RC structure.

According to the present invention, a metal fitting to be connected to two structural members at an intersection thereof is joined to one of the two structural members in a manner where the applied force can be received as a shearing force. Therefore, no great tensile force is applied to a slab of the structural member. This makes it possible to effectively transmit the force to a stud connector on the beam to result in a high load bearing force of the concrete slab.

Furthermore, with respect to a steel skeleton structure, a reinforced concrete structure or a steel skeleton reinforced concrete structure, chipping of the concrete slab is not required. Therefore, there is no harmful effect experienced at locations above and below the joint structure. This makes it possible to carry out antiseismic reinforcement while people are using the structure. In addition, it may not be necessary to, for example, clean up the area after chipping. This enables the required time period for assembly of the joint structure to be reduced. Since welding on site in the background art results in a weld that is low in reliability with regard to the welding strength, a more reliable joint structure for antiseismic reinforcement can be provided.

If the size of a gusset plate of the metal fitting is selected to have an appropriate stiffness so as to be able to follow a deformation of the structural member caused by an earthquake, detachment of the metal fitting from the structural member during an earthquake can be prevented. This leads to a joint structure that has an antiseismic reinforcement that is increased. The joint structure can be applied to any structures such as a steel skeleton structure, a reinforced concrete structure and a steel skeleton reinforced concrete structure.

In the above-described embodiment, the on-the-beam stud bolt 21 is fixed to the steel beam 2 as an anti-slippage part. It should be noted that the present invention is not limited to a stud bolt. Any other type of anti-slippage device such as welding can also be used. In that case, the same description of the on-the-beam stud bolt 21 can be applied.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A joint structure for antiseismic reinforcement, comprising:

a first structural member;

a second structural member;

said first and second structural members forming an intersection therebetween;

an antiseismic reinforcement member; and a metal fitting, said metal fitting having a first portion and a second portion;

wherein said first portion fixes said antiseismic reinforcement member to said first structural member with at least one fastener;

wherein said second portion joins said antiseismic reinforcement member to said second structural member without said at least one fastener; and wherein a constraining member is fixed to the second structural member at a location abutting an edge portion of the metal fitting, the constraining member bearing a force applied to the metal fitting and configured to limit movement of the metal fitting along a longitudinal axis of the second structural member.

2. The joint structure for antiseismic reinforcement according to claim 1, wherein the constraining member is fixed to the second structural member so that an applied force to the not fixed part of the metal fitting can be transmitted to the second structural member via the constraining member when a tensile force is applied to the antiseismic reinforcement member.

3. The joint structure for antiseismic reinforcement according to claim 1, wherein one side of the not fixed part of the metal fitting opposite from the constraining member abuts the first structural member so that an applied force to the metal fitting can be transmitted to the first structural member as a bearing force when a compressive force is applied to the antiseismic reinforcement member.

4. The joint structure for antiseismic reinforcement according to claim 1, wherein the metal fitting comprises a gusset plate to be connected to the antiseismic reinforcement member and joining plates to be joined to each of the structural members, and the constraining member includes a base plate which is fixed to the structural member with an adhesive and is located very close to or abutting an edge portion of the joining plate which is not fixed to the structural member.

5. The joint structure for antiseismic reinforcement according to claim 4, wherein a horizontal force caused by a tensile force from the antiseismic reinforcement member applied to the metal fitting can be borne as a shearing force by the adhesive.

6. The joint structure for antiseismic reinforcement according to claim 1, wherein the metal fitting comprises a gusset plate and joining plates to be joined to each of the structural members, and the constraining member comprises a base plate fixed to the structural member and a constraining plate formed on the base plate and located close to an edge portion of the joining plate that is not fixed to the structural member, wherein the base plate extends underneath the joining plate to reach the intersection formed by the first and second structural members.

7. The joint structure for antiseismic reinforcement according to claim 1, wherein the first structural member is a column, the second structural member is a concrete slab on a beam, and the antiseismic reinforcement member is a brace.

8. A joint structure for antiseismic reinforcement, comprising:

a straight structural member;

a pair of antiseismic reinforcement members; and a metal fitting, said metal fitting having a first portion and a second portion;

wherein said first portion joins one of said antiseismic reinforcement members to said straight structural member;

wherein said second portion joins the other one of said antiseismic reinforcement members to said straight structural member;

wherein the pair of antiseismic reinforcement members are joined to the straight structural member in a different direction from each other;

wherein the metal fitting is not fixed to the straight structural member;

a first constraining member and a second constraining member;

wherein the first constraining member is directly fixed to the straight structural member, abutting, but not connected to a first edge of said first portion of said metal fitting;

wherein the second constraining member is directly fixed to the straight structural member, abutting, but not connected to a second edge of said second portion of said metal fitting;

wherein the first and second constraining members bear a force to be applied to the metal fitting; and wherein the first and second constraining members are configured to limit movement of said metal fitting along a longitudinal axis of the straight structural member.

9. The joint structure for antiseismic reinforcement according to claim 8, wherein the metal fitting comprises a gusset plate to be connected to the antiseismic reinforcement member and a joining plate to be joined to the straight structural member, and the constraining member is fixed to the straight structural member with an adhesive and is located very close to or abutting an edge portion of the joining plate.

10. The joint structure for antiseismic reinforcement according to claim 9, wherein a horizontal force caused by a tensile force from the antiseismic reinforcement member applied to the metal fitting can be borne as a shearing force by the adhesive.

11. A joint structure for antiseismic reinforcement, comprising:

at least one structural member having a longitudinal axis;

at least one antiseismic reinforcement member, each of the at least one antiseismic reinforcement member having a longitudinal axis located in a plane that is generally parallel to a plane in which the longitudinal axis of the at least one structural member is located, the longitudinal axis of the antiseismic reinforcement member being obliquely inclined with respect to the longitudinal axis of the structural member;

a metal fitting, said metal fitting having at least one portion;

wherein said at least one portion joins the at least one antiseismic reinforcement member to the at least one structural member;

wherein the metal fitting is not fixed to the at least one structural member;

at least one constraining member;

wherein the at least one constraining member is directly fixed to the at least one structural member, abutting, but not connected to a first edge of said at least one portion of said metal fitting;

wherein the at least one constraining member bears a force to be applied to the metal fitting; and wherein the at least one constraining member is configured to limit movement of said metal fitting along the longitudinal axis of the at least one structural member.

12. The joint structure for antiseismic reinforcement according to claim 11, wherein the structural member includes a first structural member and a second structural member, said first and second structural members form an intersection therebetween, and said metal fitting joins said antiseismic reinforcement member to the intersection between the first and second structural members.

13. The joint structure for antiseismic reinforcement according to claim 12, wherein one part of the metal fitting is fixed to the first structural member using a fastener, and another part of the metal fitting is not fixed to the second structural member, and the constraining member is fixed to the second structural member.

14. The joint structure for antiseismic reinforcement according to claim 13, wherein the constraining member is fixed to the second structural member so that an applied force to the not fixed part of the metal fitting can be transmitted to the second structural member via the constraining member when a tensile force is applied to the antiseismic reinforcement member.

15. The joint structure for antiseismic reinforcement according to claim 13, wherein one side of the not fixed part of the metal fitting opposite from the constraining member abuts the first structural member so that an applied force to the metal fitting can be transmitted to the first structural member as a bearing force when a compressive force is applied to the antiseismic reinforcement member.

16. The joint structure for antiseismic reinforcement according to claim 13, wherein the metal fitting comprises a gusset plate to be connected to the antiseismic reinforcement member and a joining plate to be joined to each structural member, and the constraining member includes a base plate which is fixed to the structural member with an adhesive and is located very close to or abutting an edge portion of the joining plate which is not fixed to the structural member.

17. The joint structure for antiseismic reinforcement according to claim 16, wherein a horizontal force caused by a tensile force from the antiseismic reinforcement member applied to the metal fitting can be borne as a shearing force by the adhesive.

18. The joint structure for antiseismic reinforcement according to claim 13, wherein the metal fitting comprises a gusset plate and a joining plate to be joined to each structural member, and the constraining member comprises a base plate fixed to the structural member and a constraining plate formed on the base plate and located close to an edge portion of the joining plate that is not fixed to the structural member, wherein the base plate extends underneath the joining plate to reach the intersection formed by the first and second structural members.

19. The joint structure for antiseismic reinforcement according to claim 13, wherein the first structural member is a column, the second structural member is a concrete slab on a beam, and the antiseismic reinforcement member is a brace.

20. The joint structure for antiseismic reinforcement, according to claim 11, wherein said at least one structural member is a straight structural member, said at least one antiseismic reinforcement member is a pair of antiseismic reinforcement members, the metal fitting connects each of the pair of antiseismic reinforcement members to the straight structural member in different direction from each other, the metal fitting is not fixed to the straight structural member and a pair of said at least one constraining members bear a force to be applied to the metal fitting.

21. The joint structure for antiseismic reinforcement according to claim 20, wherein the metal fitting comprises a gusset plate to be connected to the antiseismic reinforcement member and a joining plate to be joined to the straight structural member, and the constraining member is fixed to the straight structural member with an adhesive and is located very close to or abutting an edge portion of the joining plate.

22. The joint structure for antiseismic reinforcement according to claim 21, wherein a horizontal force caused by a tensile force from the antiseismic reinforcement member applied to the metal fitting can be borne as a shearing force by the adhesive.

* * * * *